US006612482B2

(12) United States Patent
Ross

(10) Patent No.: US 6,612,482 B2
(45) Date of Patent: Sep. 2, 2003

(54) COLLAPSIBLE CARTON SLEEVE

(75) Inventor: Michael Edward Ross, Oxford, CT (US)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/994,409

(22) Filed: Nov. 27, 2001

(65) Prior Publication Data

US 2003/0098343 A1 May 29, 2003

(51) Int. Cl.[7] ..... B65D 5/42
(52) U.S. Cl. ..... 229/103.2; 206/784
(58) Field of Search ..... 229/103.2; 206/427, 206/434, 476, 784

(56) References Cited

U.S. PATENT DOCUMENTS

| | | | | |
|---|---|---|---|---|
| 2,904,170 A | * | 9/1959 | Hennessey et al. | 229/103.2 |
| 3,604,614 A | | 9/1971 | Sternfeld | |
| 4,438,843 A | * | 3/1984 | Graser | 206/427 |
| 4,646,917 A | | 3/1987 | Schuster | |
| 4,925,019 A | * | 5/1990 | Ganz et al. | 206/427 |
| 5,000,313 A | * | 3/1991 | Oliff | 206/427 |
| 5,180,100 A | | 1/1993 | Shimizu | |
| 5,360,104 A | | 11/1994 | Sutherland | |
| 5,390,848 A | * | 2/1995 | Gungner et al. | 229/103.2 |
| 5,421,458 A | | 6/1995 | Campbell | |
| 5,429,239 A | * | 7/1995 | Baxter | 229/103.2 |
| 5,558,213 A | * | 9/1996 | Sutherland | 229/103.2 |
| 5,765,685 A | * | 6/1998 | Roosa | 206/434 |
| 5,941,389 A | | 8/1999 | Gomes | |
| 6,227,367 B1 | * | 5/2001 | Harrelson et al. | 206/427 |
| 6,394,337 B1 | * | 5/2002 | Ross et al. | 229/103.2 |

OTHER PUBLICATIONS

TV Advertisement for Swiffer Wet Product–air date Nov. 8, 2000. Product launched Oct. 2000.
Magazine advertisement for Kanebo Wipes—Product launch Mar. 9, 2001.

* cited by examiner

*Primary Examiner*—Gary E. Elkins
(74) *Attorney, Agent, or Firm*—Alan A. Bornstein

(57) ABSTRACT

A sleeve is provided which in assembled form slides over an openable carton with a protuberance to maintain the carton in its closed position. The sleeve may be assembled prior to production and stored flat or in a roll to minimize storage space and save production costs.

5 Claims, 3 Drawing Sheets

COLLAPSIBLE CARTON SLEEVE

BACKGROUND

1. Field of the Invention

The present invention relates generally to a product sleeve blank and more particularly to an assembled collapsible tubular product sleeve for holding products with protuberances so as to minimize the space occupied by the assembled sleeve during shipping, handling, and subsequent production.

2. Related Art

U.S. Pat. No. 5,725,144 issued Mar. 10, 1998 to Stone et al. describes a unique shaped carton and a method to expand or contract the carton over an internal product. This disclosure differs from the instant invention in that the inventive sleeve does not contract or expand once the product is placed within it. Other prior art techniques relate to placing a multi-panel carton on top of a rigid container during filling. This also offers a surface for graphic printing but the carton does not encompass the entire perimeter of the tub in this application. For example, this technology is seen in Mr. Clean™ Wipe-Ups™ package available from Procter & Gamble.

SUMMARY OF THE INVENTION

One aspect of the present invention is a carton sleeve blank having five or more panels designed to fit along the perimeter of a trapezoidal-shaped rigid tub-style package in assembled form. Preferably, the tub-style package will have at least one protuberance. Of particular importance in the inventive sleeve design is the addition of at least one extra fold line in each of the side panels that allows for the sleeve to be assembled at the carton manufacturer (converter). This pre-gluing or attachment operation allows the assembled sleeve to be shipped in the knocked down, flat position until it is erected during final product production and a rigid sleeve is slid onto the carton.

One benefit is that the inventive sleeve allows for greater decoration area and also provides a method of keeping a rigid package (e.g. a tub with a hinged top lid) closed until ready to use. In addition, the pop-open and fill behavior of the sleeve can be utilized on a wider array of traditional, high-speed filling equipment thereby allowing flexibility and low cost in manufacturing.

The inventive sleeve has a trapezoidal shape when erected, that is, two or more opposing panels having different sizes, which follow along the perimeter of the rigid or semi-rigid package contained within. The sleeve can be manufactured from materials such as, but not limited to, solidbleach sulfate, Kraft paper stock, clay coated newsboard stock, or any other flexible plastic, paper stock, hinged rigid materials, or laminates thereof and the like, in various thicknesses, sufficient to maintain the integrity of the carton during manufacturing. Rigid materials may also be used provided they have weakened or fold lines inserted in the sleeve blank prior to assembly into a tubular sleeve. The material must also be strong enough to keep the lid of the package closed until ready for use.

Traditionally, non square or trapezoidal cartons, due to their geometric shape, must be assembled either automatically or manually at the time of manufacture. That is, the sleeve is wrapped around the rigid package and glued into place on the manufacturing line. This process known as jacket packaging, can be slow and, therefore, more expensive than the traditional pop-up and fill method used on square-shaped packages. The inventive sleeve is comprised of a minimum of 5 panels (not including the panels defined by additional fold lines) and contains two parallel surfaces or major panels of different sizes. Adjacent to those parallel surfaces are non-parallel, side panels which connect the parallel major panels and a connection or adhesive panel which connects one side panel to one major panel when the sleeve is assembled. Primary fold lines separate major panels from side panels and a side panel from the connection panel. Additional fold lines are present as described below In a further aspect of the invention is provided a sleeve blank for forming an assembled sleeve for enveloping a package having a protuberance along a profile thereof, comprising:

(a) a first major panel;

(b) a first and a second side panel each having a first and a second end connected to said first major panel along opposed parallel primary fold lines at each side panel's first end;

(c) a connecting panel connected to said first side panel's second end;

(d) a second major panel connected to said second side panel along a primary fold line at said second side panel's second end;

wherein said first side panel has an additional fold line disposed adjacent to said product's protuberance after insertion of said product in said assembled sleeve; and wherein said second side panel has the same number of additional fold lines as said second panel.

In a preferred embodiment of the assembled sleeve, when the assembled sleeve is laid in the knocked down position, the assembled sleeve is substantially flat. Upon erecting the assembled sleeve on the production line, the additional fold lines in the side panels straighten, bringing the two adjoining sub-panels substantially into the same plane. The rigid package, for example a tub, is then slid into the assembled sleeve.

Preferred embodiments of the invention will now be described by way of example with reference to the accompanying drawings, wherein like figures represent like features.

DESCRIPTION OF THE PREFERRED EMBODIMENTS

Figure 1:
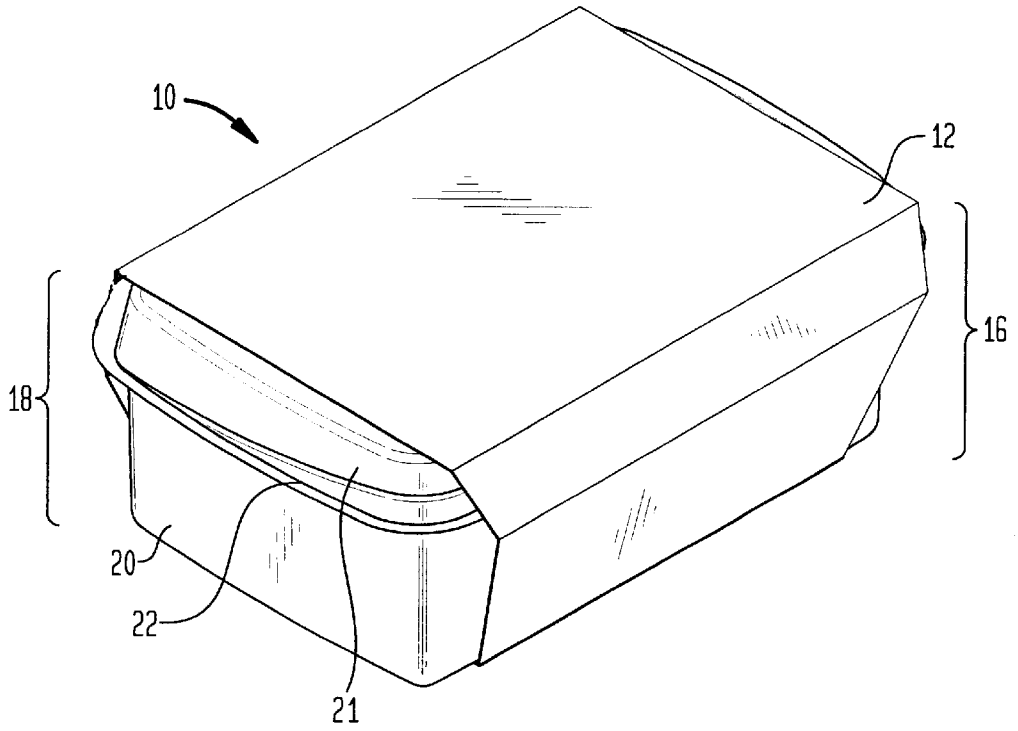
FIG. 1 is a perspective view of the assembled sleeve wrapped around a tub viewed from one end.

Referring to FIGS. 1–5, a carton sleeve 10 is formed from paperboard, plastic, or similar foldable or hingeable sheet material and the like. The sleeve includes a first major panel 12 a second major panel 14 a first side panel 16 and a second side panel 18 respectively hinged one to the next forming a tubular sleeve when connecting panel 24 is attached to second major panel 14.

Referring to FIG. 1, tub 20 is shown positioned within carton sleeve 10. Tub 20 has tub protrusion 22 and tub lid 21.

Figure 2:
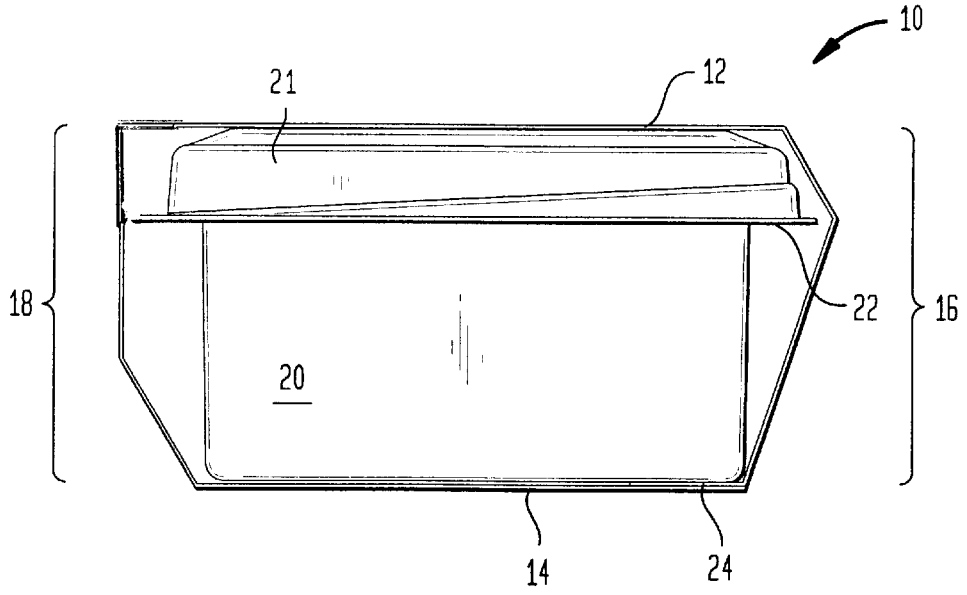
FIG. 2 is an end elevational view of the sleeve and package shown in FIG. 1.

FIG. 2 represents an end-view of the tub and sleeve combination illustrated in FIG. 1. Also illustrated in FIG. 2 is connecting panel 24 which joins the first side panel 16 to the second major panel 14 using a suitable adhesive or other attachment technique.

Figure 3:
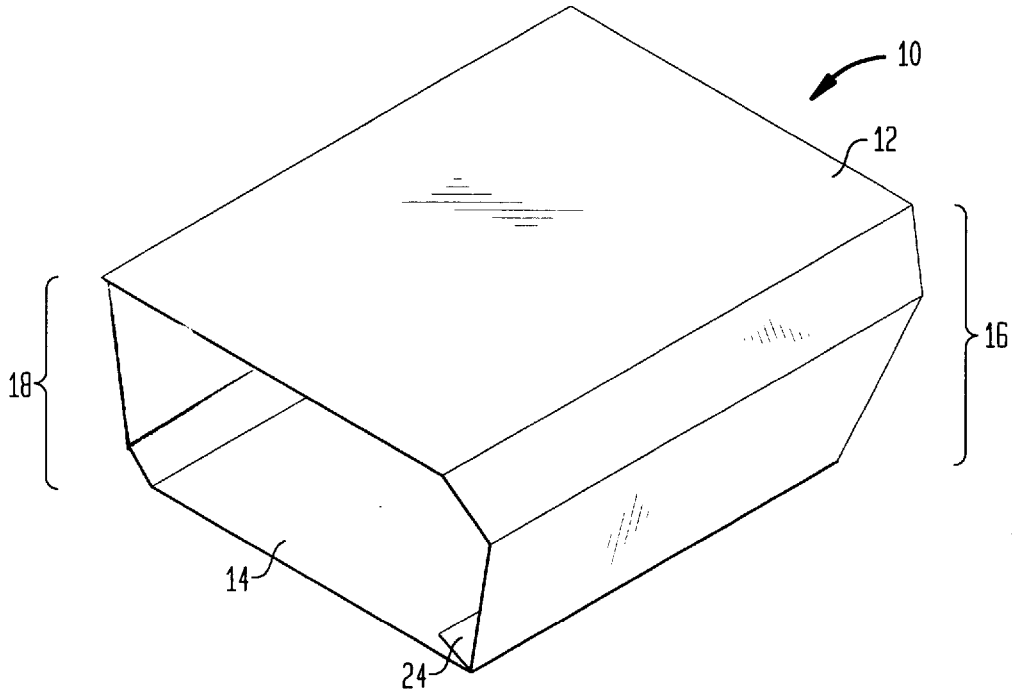
FIG. 3 is a perspective view of the assembled sleeve without the tub that is shown in FIG. 1.

FIG. 3 represents the assembled carton sleeve 10 depicted in FIG. 1 without the tub 20.

Figure 4:
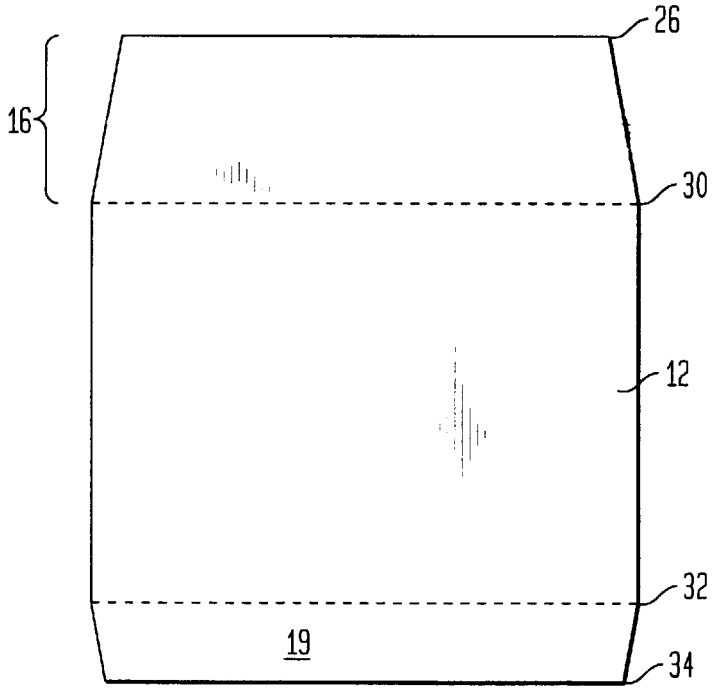
FIG. 4 is a top planar view of the assembled sleeve in a knocked down, flattened position.

Now referring to FIG. 4, assembled carton sleeve 10 is depicted in a substantially flattened, knocked down position suitable for shipment and storage. Also depicted are major panel 12, first side panel 16, an exposed portion of the first side panel 19, primary fold lines 30, and 32, and additional fold lines 26 and 34.

Figure 5:
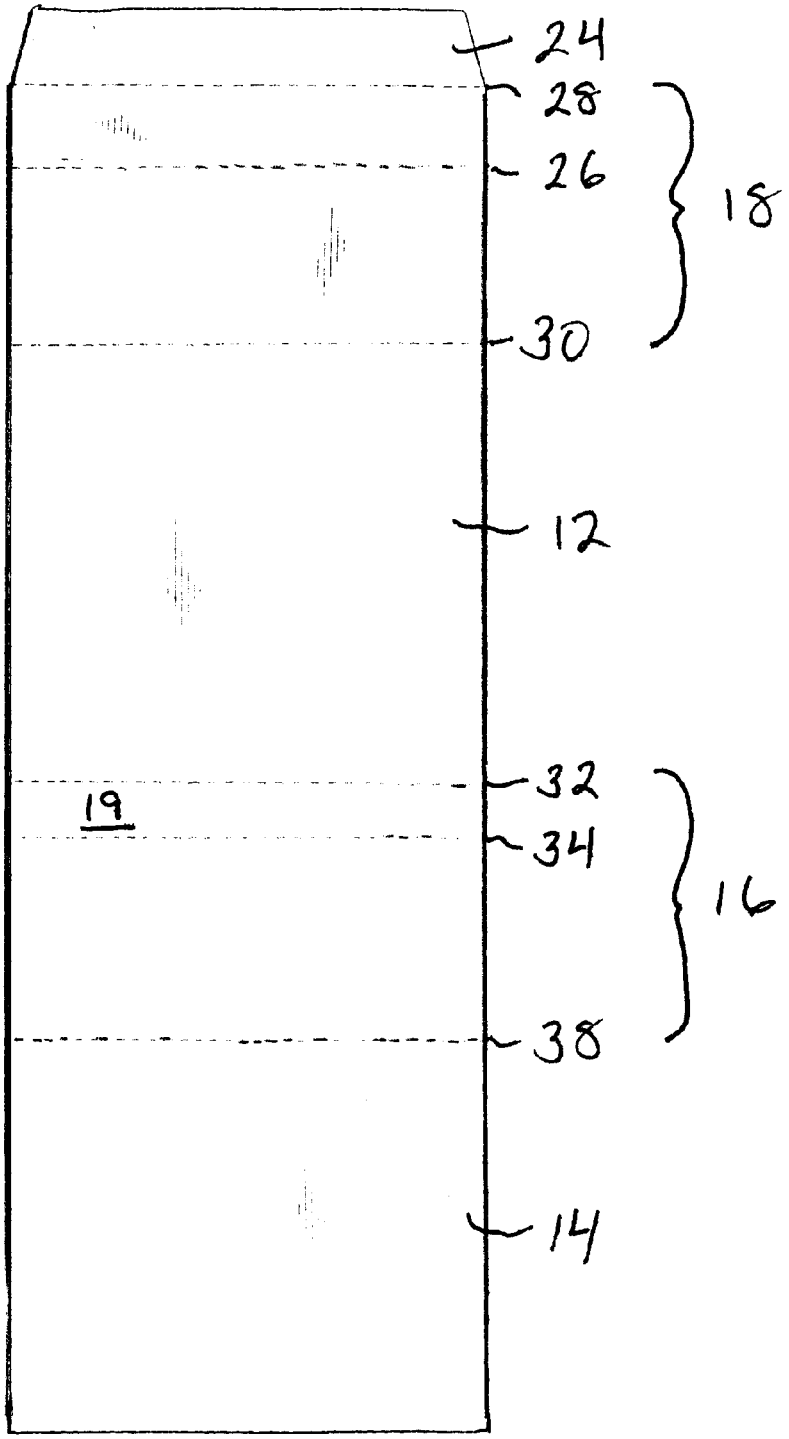
FIG. 5 is a top planar view of the sleeve blank shown in FIGS. 1–4 in assembled form.

Now referring to FIG. 5, the unassembled carton sleeve blank 40 which forms assembled sleeve 10, is shown with first major panel 12, second major panel 14, first side panel 16, second side panel 18, connecting panel 24, primary fold lines 28, 30, 32, and 38, and additional fold lines 26 and 34.

While this invention has been described with respect to a particular embodiment thereof, it is apparent that numerous other forms and modifications of the invention will be obvious to those skilled in the art. The appended claims and this invention generally should be construed to cover all such obvious forms and modifications which are within the true spirit and scope of the present invention.

I claim:

1. A sleeve blank for forming an assembled sleeve for enveloping a package having a protuberance along a profile thereof, comprising:

(a) a first major panel;

(b) a first and a second side panel each having a first and a second end connected to said first major panel along opposed parallel primary fold lines at said side panel's first end;

(c) a connecting panel connected to said first side panel's second end;

(d) a second major panel connected to said second side panel along a primary fold line at said second side panel's second end;

wherein said first side panel has an additional fold line disposed adjacent to said product's protuberance after insertion of said product in said assembled sleeve; wherein said second side panel has the same number of additional fold lines as said first side panel; wherein each of said additional fold line of said first side panel defines a fold line plane that is parallel to said first major panel and each of said additional fold lines of said second side panel define a fold line plane that is parallel to said first major panel; and wherein none of said fold line planes are superimposed on each other.

2. The sleeve blank of claim 1 wherein said first side panel has one additional fold line and second side panel has one additional fold line.

3. The sleeve blank of claim 1 wherein the sleeve material is selected from paper board, flexible plastic, metal foil, hinged rigid material, or laminates thereof.

4. The sleeve blank of claim 1 further comprising joining said connecting panel to its opposite panel to form a tubular sleeve for receiving a product with a protuberance.

5. The sleeve blank of claim 4 wherein said connecting panel is joined to its opposite panel with a technique selected from adhesives, staples, thermal sealing, and interlocking tabs.

* * * * *